United States Patent [19]

Leadvaro et al.

[11] 3,979,627

[45] Sept. 7, 1976

[54] ELECTRIC LAMP WITH INSULATING BASE

[75] Inventors: Stephen J. Leadvaro, Salem; Paul E. Gates, Danvers; Stephen F. Kimball, Georgetown, all of Mass.

[73] Assignee: GTE Sylvania Incorporated, Danvers, Mass.

[22] Filed: Apr. 28, 1975

[21] Appl. No.: 572,609

[52] U.S. Cl. ..... 313/318; 313/315; 339/144 R

[51] Int. Cl.[2] ..... H01J 5/48; H01J 5/50

[58] Field of Search ..... 313/315, 318; 339/144 R

[56] References Cited

UNITED STATES PATENTS

| | | | |
|---|---|---|---|
| 2,483,351 | 9/1949 | Richardson | 313/318 X |
| 2,937,308 | 5/1960 | Howles et al. | 313/315 |
| 3,541,381 | 11/1970 | Matsuya | 313/318 |
| 3,619,702 | 11/1971 | Albrecht | 313/318 |
| 3,829,729 | 8/1974 | Westlund, Jr. et al. | 313/318 |
| 3,859,554 | 1/1975 | Preziosi et al. | 313/318 |

*Primary Examiner*—Saxfield Chatmon, Jr.
*Attorney, Agent, or Firm*—Edward J. Coleman

[57] ABSTRACT

An electric lamp having a light-transmitting envelope, such as a glass bulb, secured to a plastic base having a symmetrical wedge-lock portion. Lead-in wires from the glass bulb are threaded through channels in the plastic base and are bent around the wedge-lock portion to form contacts without soldering.

10 Claims, 4 Drawing Figures

ELECTRIC LAMP WITH INSULATING BASE

BACKGROUND OF THE INVENTION

This invention relates to electric lamps and, more particularly, to an improved base for such lamps.

The features of the present invention are particularly useful as applied to the construction of the incandescent lamps employed in automobiles, such as the dual-filament lamps employed in tail light assemblies. Prior lamps of this type generally employed a type S-8 glass bulb cemented in a brass double contact bayonet base. Although used for a number of years, such bases pose a number of disadvantages. For example, anyone who has replaced such a lamp in their automobile will appreciate the great difficulty experienced in position-referencing the base to insure the proper lamp-to-socket orientation. The base is cylindrical and the only orientation reference means are small indexing pins at the sides of the base. This referencing problem also holds true for automatic insertion of the lamp into the socket during production assembly. Further, the lamp to base construction for the dual filament lamp requires three soldering points for electrical connections (the two lead-in wires serving as the common connection are twisted and soldered to the sidewall of the base, while the other two wires are respectively soldered to the twin contact nodes at the bottom of the base). This leads to corrosion or other contact degradation problems caused by soldering fluxes. Finally, the bayonet base lamp requires a somewhat complicated and relatively expensive socket design.

BRIEF SUMMARY OF THE INVENTION

Accordingly, it is an object of the present invention to provide an electric lamp with improved base construction.

It is a particular object to provide a lamp with an improved base that can be loaded into its socket more readily than the prior art lamp, use a less expensive socket, eliminate soldering problems, and reduce base and socket corrosion problems, which in turn cause electrical problems.

These and other objects, advantages and features are attained, in accordance with the principles of this invention, by an electric lamp having a light-transmitting envelope with a sealed end portion which is secured in an insulating base member having a depending wedge-lock portion. A plurality of lead-in wires extending through the sealed end portion of the lamp envelope are threaded into respective channels passing through the wedge-lock portion of the base. Each of the wires have a terminal portion which extends outwardly from the end of the wedge-lock portion and is bent therearound to extend alongside the wedge-lock portion and terminate past a transverse lock-in means thereon. The base locating means are symmetrically disposed on opposed flat sides of the wedge-lock portion, and the lead-in wires bent back along each side of the wedge-lock portion function as the lamp contacts without the need for solder joints. The base may be formed of plastic, with a conventional lamp bulb being cemented within a cavity thereof, thereby inexpensively providing a substantially improved lamp construction which can easily be oriented into a relatively simple socket construction.

BRIEF DESCRIPTION OF THE DRAWINGS

The invention will be more fully described hereinafter in conjunction with the accompanying drawings, in which.

DESCRIPTION OF PREFERRED EMBODIMENT

Figure 1:
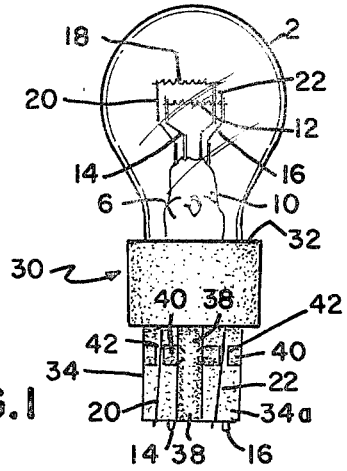
FIG. 1 is a front elevational view of one embodiment of an incandescent lamp with an insulating base in accordance with the invention.
Figure 2:
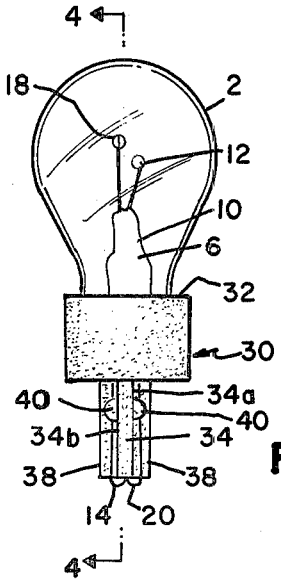
FIG. 2 is a side view of the lamp of FIG. 1.
Figure 3:
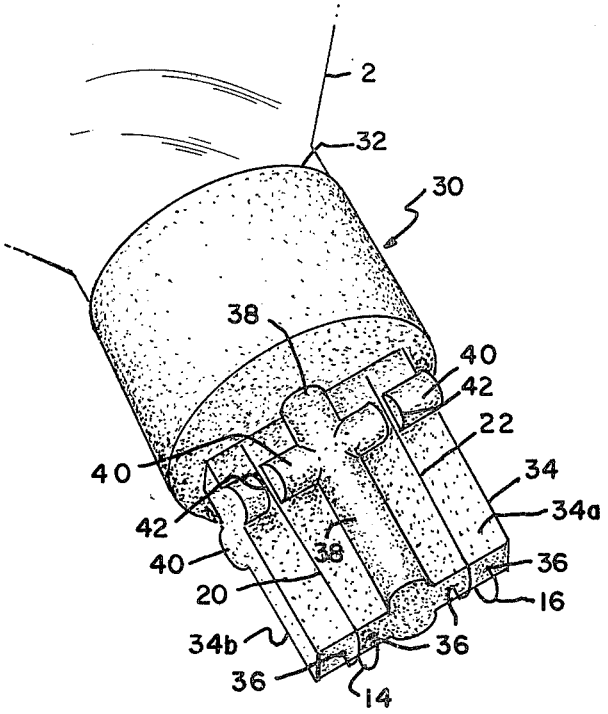
FIG. 3 is a fragmentary perspective view of the base end of the lamp on a greatly enlarged scale.

Referring to the drawings, a lamp according to the invention is shown comprising a light-transmitting envelope in the form of a glass bulb 2 having a dual filament mount structure sealed into one end thereof. The envelope is filled with a rare gas, such as argon, at approximately atmospheric pressure and thereafter hermetically sealed in the usual manner by tipping off the exhaust tube 4 (see FIG. 4) at the sealed end of the lamp.

The mount structure includes the typical reentrant glass stem 6 having at one end a flare portion 8 (FIG. 4) which is sealed about its periphery to the end of the glass bulb 2, and a press 10 at the inward end supporting a pair of filament mount structures. More specifically, a first coiled filament 12 is supported by and electrically connected to a pair of lead-in wires 14 and 16 sealed through the stem press 10, and a second coiled filament 18 is supported by and electrically connected to a pair of lead-in wires 20 and 22 sealed through the stem press. Each filament spans the inner ends of its respective pair of lead-in wires, with the ends of the coiled filament being clamped by the lead-in wires to provide the electrical connection thereto.

In accordance with the invention, the lamp is provided with an improved base member formed of an electrically insulating material such as plastic or ceramic. Preferably, the base is of a one-piece molded construction 30 having a cylindrical cavity 32 that is larger than the sealed end portion of the envelope and a depending wedge-lock portion 34. The wedge-lock portion has opposed substantially flat sides **34*a* and 34*b* with locating means symmetrically formed on each of the opposed sides. In this instance, the locating means on each side comprise a central axial rib 38 and a transverse rib 40. When the base is inserted in a socket, the set of central ribs 38 serve as a centering key, and the set of transverse ribs 40** provide lock-in means.

Figure 4:
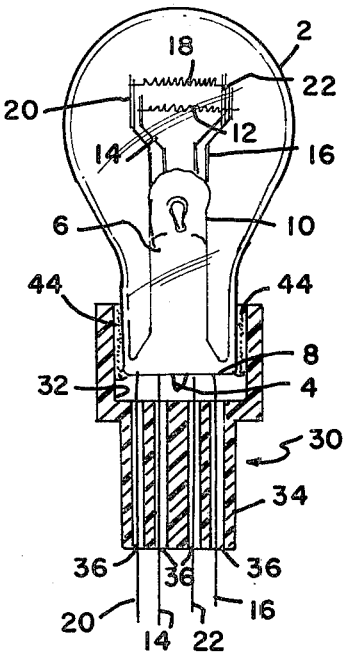
FIG. 4 is a sectional view on line 4—4 of FIG. 2 showing the base cavity and lead channels, but with the lead-in wires shown in their initial straightened position prior to bending about the wedge-lock portion, and with the lamp bulb shown in elevation.

As best shown in FIG. 4, a plurality of lead channels 36, in this case four, pass through the wedge-lock portion of the base member and communicate with the cavity 32. The sealed end portion of the lamp envelope is seated within the cavity 32, while the lead-in wires 14, 16, 20 and 22 extending from the lamp seal are threaded into and through respective ones of the channels 36. The terminal portions of the lead-in wires extending outwardly from the end of the wedge-lock portion 34 are then bent around the lower end of the base and directed to extend alongside and parallel to the flat sides thereof and terminate past the transverse lock-in rib 40. More specifically, as illustrated in FIGS.

1, 2 and 3, the terminal portions of lead-in wires 20 and 22 are directed to extend alongside and parallel to the flat side 34*a* of the wedge-lock portion of the base, while the terminal portions of lead-in wires 14 and 16 are directed to extend alongside and parallel to the other of the flat sides, i.e., side 34*b*. Each of the transverse ribs 40 has a pair of slots 42 for accommodating the terminal portions of the pair of lead wires extending on the side on which the rib is formed. Thus, the terminal portions of wires 20 and 22 lie in respective slots 42 and terminate past the rib 40 on side 34*a*, while the terminal portions of wires 14 and 16 lie in respective slots 42 (not shown) and terminate past the rib 40 on side 34*b*.

Although it is possible in a given application that the glass lamp bulb 2 may be secured within the cylindrical base cavity 32 by the bent around lead-in wires, it is preferred that the bulb be secured within the base by a layer of cement 44 (FIG. 4) between the sealed end portion of the bulb and cavity 32.

According to one specific embodiment, a type S-8 dual-filament automotive lamp bulb 2 is mounted in a single-piece plastic base 30 formed of Bakelite. The bulb envelope 2 is formed of a lime glass, while the reentrant stem is of Corning type 0120 lead glass. The tungsten filaments 12 and 18 are mounted on dumet lead-in wires 14, 16, 20 and 22, and the bulb is filled with argon at about atmospheric pressure. The base is formed as shown in the drawings, and the lead-in wires are threaded into the base and bent around as illustrated. A conventional lamp cement 44 is used to secure the sealed end portion of the bulb within the base cavity 32.

This improved base design permits ready conversion of existing lamp bulb types, with the lead-in wires functioning as electrical contacts, thereby eliminating the need for soldering. The base is symmetrically formed so that it can be easily oriented for machine loading into sockets, which are now permitted to be of a more simplified and less expensive construction. Further the insulating base with solderless contacts significantly minimizes base and socket corrosion problems.

Although the invention has been described with respect to a specific embodiment, it will be appreciated that modifications and changes may be made by those skilled in the art without departing from the true spirit and scope of the invention. For example, the improved base is obviously not limited to lamps with dual filaments but may be readily employed with single filament lamps. The base can be non-symmetrical to assure installation in one direction only.

What we claim is:

1. An electric lamp comprising, in combination:

an hermetically sealed, light-transmitting envelope containing a pair of filaments and having a sealed portion at one end;

an insulating base member having a cavity that is larger than the sealed end portion of said envelope, a depending wedge-lock portion having opposed substantially flat sides with locating means, including a transverse lock-in means, disposed thereon, and four channels passing through said wedge-lock portion and communicating with said cavity, said sealed end portion of the envelope being secured within said base cavity; and a respective pair of lead-in wires connected to each of said filaments, whereby four lead-in wires extend through the sealed end portion of said envelope and into the four respective channels in said base member, each of said lead-in wires having a terminal portion extending outwardly from the end of the wedge-lock portion of said base member, the terminal portions of a first pair of said lead-in wires being bent around the end of said wedge-lock portion and extending alongside and approximately parallel to one of the flat sides thereof and terminating past the transverse lock-in means thereon, and the terminal portions of a second pair of said lead-in wires being bent around the end of said wedge-lock portion and extending alongside and approximately parallel to the other of the flat sides thereof and terminating past the transverse lock-in means thereon.

2. A lamp according to claim 1 wherein said base member is formed of a plastic material, and said sealed end portion of said envelope is secured within said plastic base cavity by a layer of cement therebetween.

3. An electric lamp comprising, in combination:

an hermetically sealed, light-transmitting glass bulb containing an energizable source of light and having a sealed portion at one end comprising a reentrant glass stem;

a plastic base member having a cylindrical cavity that is larger than the sealed end portion of said envelope, a depending wedge-lock portion, and a plurality of channels passing through said wedge-lock portion and communicating with said cavity, said sealed end portion of the envelope being secured within said base cavity; and a plurality of lead-in wires extending through the sealed end portion of said envelope and into the respective channels in said base member, each of said lead-in wires having a terminal portion extending outwardly from the end of the wedge-lock portion of said base member and being bent around the end of and alongside said wedge-lock portion and terminating past a tranverse lock-in means thereon.

4. A lamp according to claim 3 wherein said depending wedge-lock portion of said base member has opposed substantially flat sides with locating means, including said transverse lock-in means, symmetrically disposed thereon, the terminal portion of at least a first one of said lead-in wires being bent around the end of said wedge-lock portion and extending alongside and approximately parallel to one of the flat sides thereof, and the terminal portion of at least a second one of said lead-in wires being bent around the end of said wedge-lock portion and extending alongside and approximately parallel to the other of the flat sides thereof.

5. A lamp according to claim 4 wherein said energizable source of light comprises a pair of filaments each of which is connected to a respective pair of lead-in wires, whereby four lead-in wires extend through the reentrant stem of said envelope into four respective channels in said base member, and the terminal portions of a first pair of said lead-in wires are bent around the end of said wedge-lock portion and extend alongside and approximately parallel to one of the flat sides thereof, and the terminal portions of a second pair of said lead-in wires are bent around the end of said wedge-lock portion and extend alongside and approximately parallel to the other of the flat sides thereof.

6. A lamp according to claim 5 wherein said locating means comprise a central axial rib and a transverse rib symmetrically formed on each of the opposed flat sides of the wedge-lock portion of said plastic base member.

7. A lamp according to claim 6 wherein each of said transverse ribs has a pair of slots for accommodating the terminal portions of the pair of lead-in wires extending alongside and parallel to the respective flat side of the wedge-lock on which the rib is formed, each of said transverse ribs comprising said transverse lock-in means and the terminal portions of said lead-in wires lying in the respective slots therein and terminating past said transverse ribs.

8. A lamp according to claim 4 wherein the sealed end portion of said glass bulb is secured within the cylindrical cavity of said plastic base by a layer of cement therebetween.

9. A lamp according to claim 4 wherein said locating means comprise a central axial rib and a transverse rib symmetrically formed on each of the opposed falt sides of the wedge-lock portion of said base member.

10. A lamp according to claim 9 wherein each of said transverse ribs has at least one slot for accommodating the terminal portion of one of the lead-in wires extending alongside and parallel to the respective flat side of the wedge-lock on which the rib is formed, each of said transverse ribs comprising said transverse lock-in means and the terminal portions of said lead-in wires lying in the respective slots therein and terminating past said transverse ribs.

* * * * *